US010865510B2

(12) United States Patent
Ruiz Ballesteros et al.

(10) Patent No.: US 10,865,510 B2
(45) Date of Patent: Dec. 15, 2020

(54) DISPENSER FOR WASHING MACHINES

(71) Applicant: ZOBELE ESPAÑA, S.A., Barcelona (ES)

(72) Inventors: Julio Cesar Ruiz Ballesteros, Barcelona (ES); Jordi Maso Sabaté, Barcelona (ES); Dominic Doyle, Barcelona (ES)

(73) Assignee: ZOBELE ESPAÑA, S.A., Barcelona (ES)

( * ) Notice: Subject to any disclaimer, the term of this patent is extended or adjusted under 35 U.S.C. 154(b) by 0 days.

(21) Appl. No.: 15/106,228

(22) PCT Filed: Dec. 16, 2014

(86) PCT No.: PCT/ES2014/070924
§ 371 (c)(1),
(2) Date: Jun. 17, 2016

(87) PCT Pub. No.: WO2015/092101
PCT Pub. Date: Jun. 25, 2015

(65) Prior Publication Data

US 2016/0312397 A1 Oct. 27, 2016

(30) Foreign Application Priority Data

Dec. 19, 2013 (ES) ..... 201331868

(51) Int. Cl.
*D06F 39/02* (2006.01)

(52) U.S. Cl.
CPC ..... *D06F 39/024* (2013.01); *Y10T 29/53* (2015.01)

(58) Field of Classification Search
CPC ..... D06F 39/024; Y10T 29/53
USPC ..... 68/17 R, 235 R
See application file for complete search history.

(56) References Cited

U.S. PATENT DOCUMENTS

| | | | | |
|---|---|---|---|---|
| 3,706,140 | A | 12/1972 | Brillaud et al. | |
| 4,835,804 | A | 6/1989 | Arnau-Munoz et al. | |
| 5,393,446 | A | 2/1995 | Matsumoto | |
| 5,768,917 | A * | 6/1998 | Freida | D06F 39/024 206/0.5 |

(Continued)

FOREIGN PATENT DOCUMENTS

| | | |
|---|---|---|
| EP | 0596192 A1 | 5/1994 |
| GB | 2317378 A | 3/1998 |

(Continued)

OTHER PUBLICATIONS

Extended European Search Report dated Jul. 31, 2017 in corresponding EP Application No. 14870696.3.

*Primary Examiner* — Levon J Shahinian
(74) *Attorney, Agent, or Firm* — Knobbe, Martens, Olson & Bear, LLP

(57) ABSTRACT

The invention relates to a dispenser for washing machines, comprising a casing (1) provided with openings (2) that can house a container (3) for an active substance, and is characterized in that it also comprises a structure (4) placed inside said casing (1), said structure (4) being of a harder material than the material of said casing (1). It allows the casing to be of a material which is soft enough to not damage the clothing during the washing process, and the structure to be of a material which is hard enough to protect the active substance inside the casing.

7 Claims, 2 Drawing Sheets

(56) References Cited

U.S. PATENT DOCUMENTS

| | | | | |
|---|---|---|---|---|
| 6,523,371 | B1 * | 2/2003 | Sherratt | D06F 39/024 510/439 |
| 2005/0130861 | A1 * | 6/2005 | Aouad | D06F 39/024 510/310 |
| 2010/0044370 | A1 | 2/2010 | Barthel et al. | |
| 2011/0179585 | A1 * | 7/2011 | Chawla | B65D 47/42 8/137 |
| 2011/0204087 | A1 * | 8/2011 | Kopulos | B65D 21/0219 220/810 |

FOREIGN PATENT DOCUMENTS

| | | | |
|---|---|---|---|
| WO | 9504682 | A1 | 2/1995 |
| WO | 0017438 | A1 | 3/2000 |
| WO | 2005047588 | A1 | 5/2005 |
| WO | 2008/110300 | A1 | 9/2008 |

* cited by examiner

DISPENSER FOR WASHING MACHINES

CROSS-REFERENCE TO RELATED APPLICATIONS

This application is the U.S. National Phase under 35 U.S.C. § 371 of International Application PCT/ES2014/070924, filed Dec. 16, 2014, which claims priority to Spanish patent Application P201331868, filed Dec. 19, 2013.

OBJECT OF THE INVENTION

The present invention relates to a dispenser for washing machines, whereby an active substance inside a washing machine is delivered when clothing is washed.

BACKGROUND OF THE INVENTION

Dispensers for washing machines, used to deliver an active substance while washing clothing, are known to be used.

Dispensers of this type are placed inside the washing machine drum provided with a replaceable load of the active substance. During washing, when the active substance comes into contact with the washing water, said active substance gradually dissolves, improving the washing characteristics.

Dispensers for washing machines known today have the drawback that they can damage clothing, because the dispensing device moves inside the drum, or with the drum, when the latter turns, such that it rubs against the clothing, possibly being able to damage same. That is because the dispenser must be rigid enough to protect the active substance before it is delivered.

Therefore, the objective of the present invention is to provide a dispenser for washing machines which cannot damage clothing while washing, but which at the same time effectively protects the active substance before it is delivered.

DESCRIPTION OF THE INVENTION

Said drawbacks are solved with the dispenser for washing machines of the invention, having other advantages that will be described below.

The dispenser for washing machines according to the present invention comprises a casing provided with openings that can house an active substance, and is characterized in that it also comprises a structure placed inside said casing, said structure being of a harder material than the material of said casing.

The casing can therefore be of a material which is soft enough to not damage the clothing during the washing process, and the structure can be of a material which is hard enough to protect the active substance inside the casing.

According to a preferred embodiment, said structure is formed by a plurality of rods attached to one another and can be of plastic material, such as polyethylene, polypropylene or polyamide.

Advantageously, said casing is of elastomer, or of a similar material, and is formed by two bodies that are articulated and can be coupled to one another.

Furthermore, said casing advantageously comprises one or more magnets for fixing it to the washing machine drum.

Said casing can also comprise at least one tab to make it easier to remove the dispenser from the washing machine.

BRIEF DESCRIPTION OF THE DRAWINGS

To better understand the preceding description a set of drawings is attached in which a practical embodiment is schematically depicted by way of non-limiting example.

DESCRIPTION OF A PREFERRED EMBODIMENT

The dispenser according to the present invention is particularly designed to be used in washing machines, providing an active substance during the clothing or fabric washing process.

Said dispenser comprises a casing 1 formed of a material which could be referred to as "soft", i.e., it does not damage the clothing or the fabric inside the washing machine, taking into account that the casing rubs against the clothing during the washing process, in which the washing machine drum can turn very quickly.

In particular, said casing 1 is preferably of elastomer or of any suitable material that cannot damage the clothing.

Said casing 1 is preferably formed by two bodies 1*a*, 1*b* which can be coupled to one another in any suitable manner, one of said bodies 1*a* being provided with a housing for an active substance 3 (for example in capsule form or placed inside a membrane) and with a plurality of openings 2 for delivering or releasing the active substance during the washing process.

The need to mechanically reinforce the casing of the appliance is for two main reasons: on one hand, to prevent the device from being able to exceed the compressive strength of the container for the active substance since it is subjected to the mechanical pressure of wet clothing; on the other hand, to maintain the free circulation of water inside the casing and prevent the metering of active substance from being less than that desired since the device is compressed.

Figure 1:
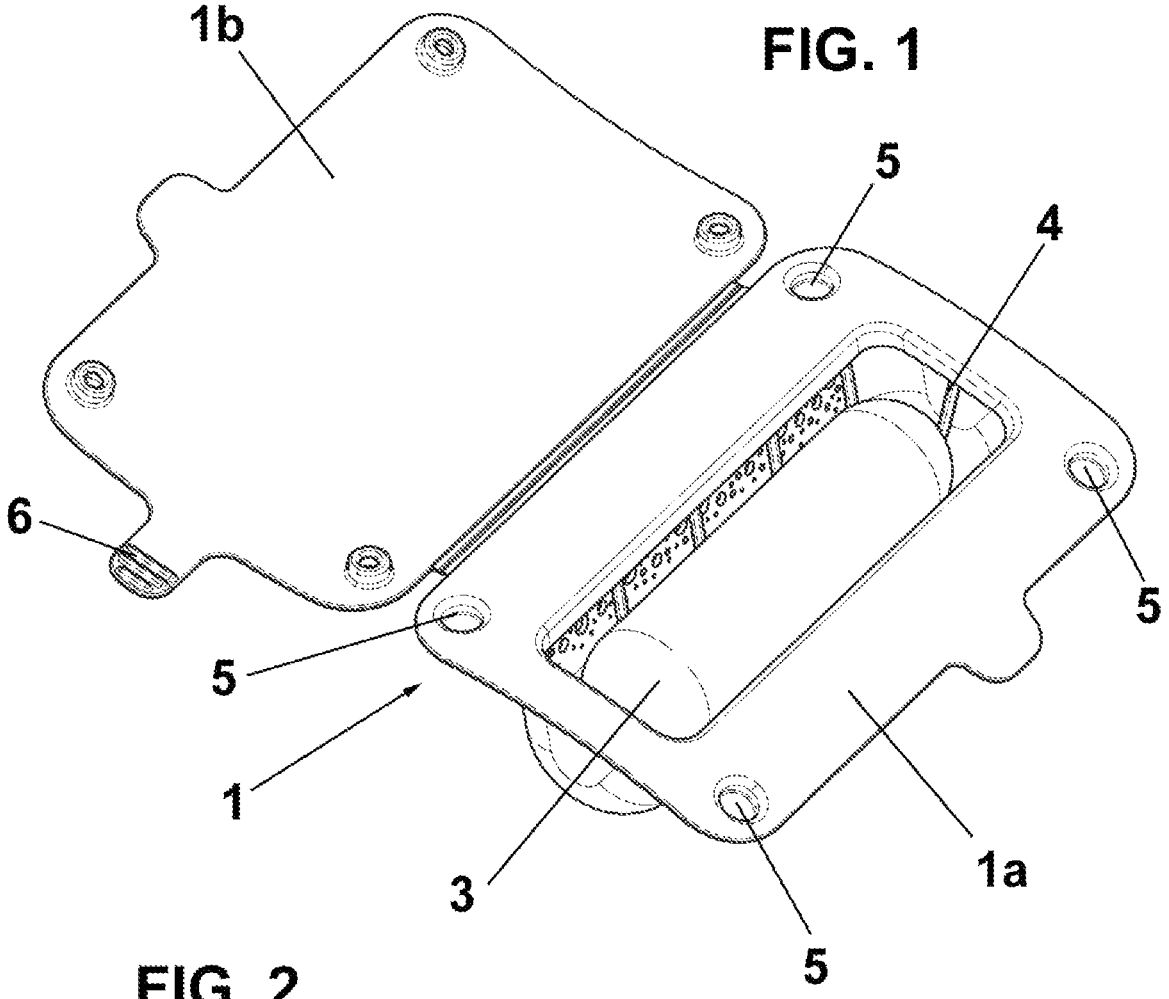
FIG. 1 is a top perspective view of the dispenser for washing machines according to the present invention, with an active substance capsule therein.
Figure 2:
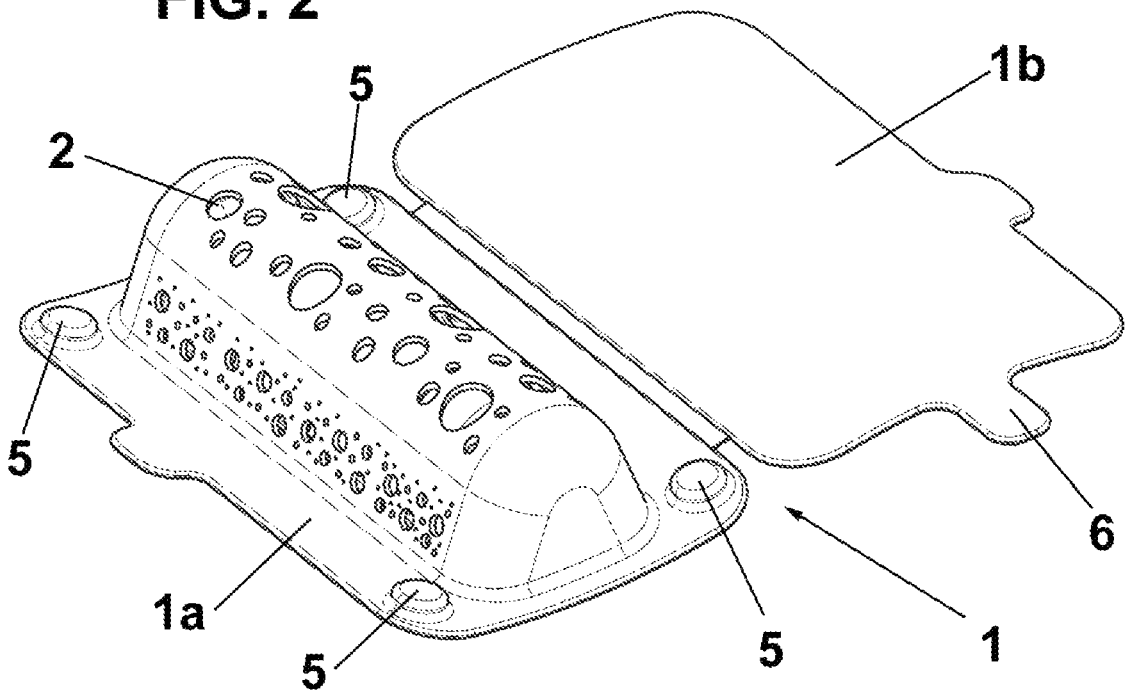
FIG. 2 is a bottom perspective view of the dispenser for washing machines according to the present invention.
Figure 3:
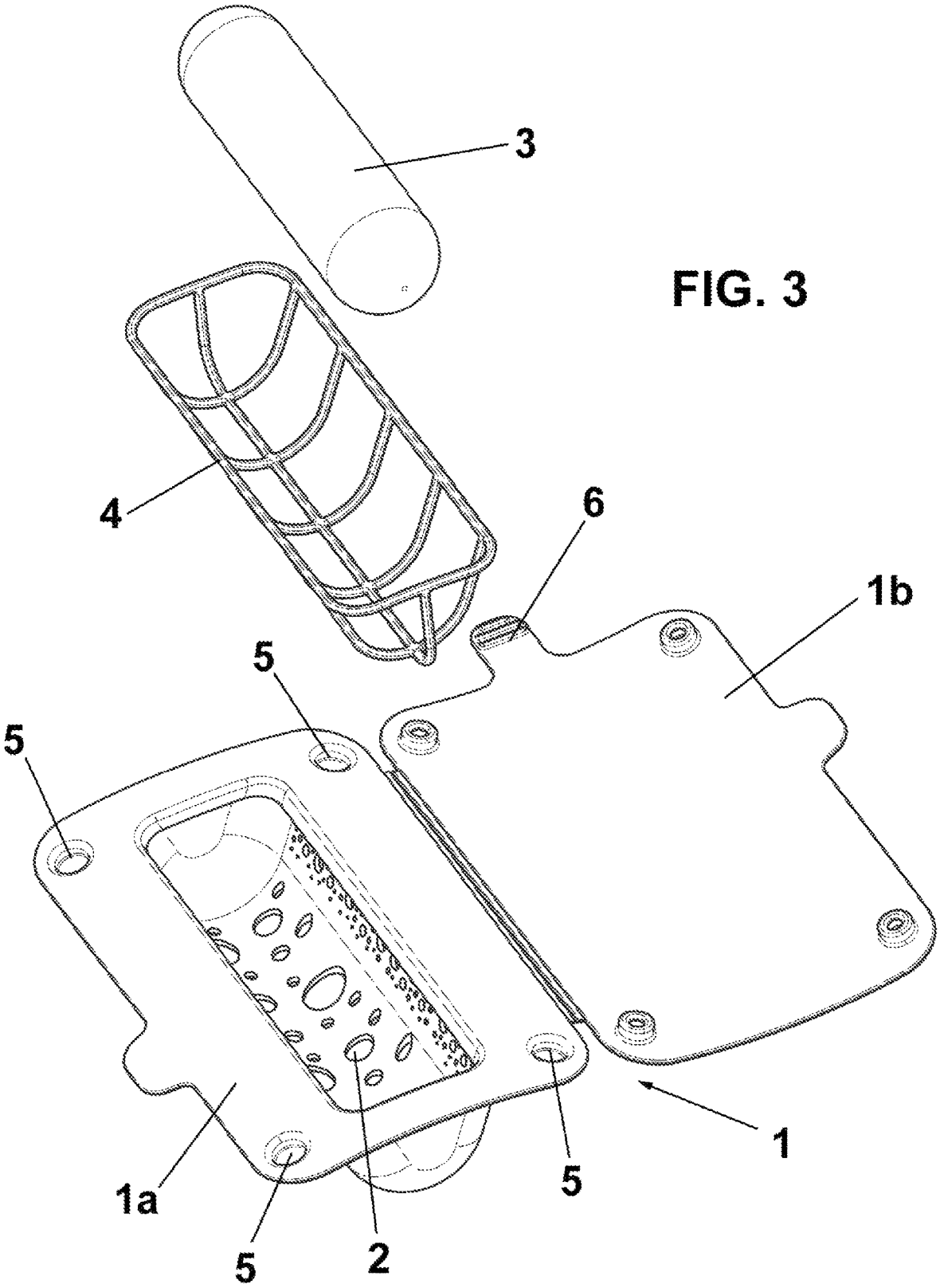
FIG. 3 is an exploded perspective view similar to FIG. 1, with the structure and the active substance capsule separated from one another.

A structure 4 is placed inside said casing 1, as can be best seen in FIG. 3. This structure 4 is of a material that could be referred to as "hard", i.e., it is rigid enough to protect said active substance 3, because said structure at least partially surrounds said active substance 3.

For example, said structure 4 can be of plastic, such as polyethylene, polypropylene or polyamide, or any other material that is hard or rigid enough. In practice, it has been found that a suitable material is any material having a degree of hardness of about 80 Shore A.

According to a preferred embodiment, said structure 4 is formed by a plurality of rods attached to one another in order to not limit the delivery of the active substance.

In a preferred embodiment, the reinforcement structure is simply arranged inside the casing without being physically attached to it. Alternatively, the two parts could also be attached by any known attachment means, including, but not limited to, glue, welding, overmolding, etc.

In order to detachably fix the casing 1 to a washing machine drum, said casing 1 comprises at least one magnet 5. In the depicted embodiment, the casing 1 comprises four magnets 5 placed in the corners of one of the bodies 1*a* forming the casing 1.

In turn, the other body 1*b* of the casing 1 is substantially flat and is provided with at least one tab 6 to make it easier to remove the casing 1 from the washing machine drum.

To use the dispenser for washing machines according to the present invention, it must simply be placed inside the washing machine drum, remaining fixed therein as a result of the magnets 5 of the casing 1.

Once the washing process starts, the water of the washing machine is introduced in the casing 1 through the openings 2 and mixed with the active substance 3, water mixed with said active substance 3 exiting the casing 1, improving the washing quality.

When the washing process ends, the dispenser of the present invention can comfortably be removed from inside the washing machine drum by pulling the tab 6 against the magnetic force of the magnets 5.

For the next washing process, a new active substance 3 in a capsule or membrane is simply placed inside the housing of said casing 1. Alternatively, a container for an active substance suitable for being used during several washing cycles could be considered.

Although reference has been made to a specific embodiment of the invention, it is obvious for a person skilled in the art that the dispenser for washing machines that has been described is susceptible to a number of variations and modifications, and that all the mentioned details can be replaced with other technically equivalent details without departing from the scope of protection defined by the attached claims.

What is claimed is:

1. Dispenser for washing machines comprising:

a casing provided with openings for a passage of liquid and formed by a first body and a second body, a housing capable to accommodate a container for an active substance formed in the first body and the openings being provided in the first body, and a structure placed inside said casing, said structure being of a harder material than the material of said casing, wherein the first body and the second body are articulated to each other and can be coupled to one another, said first body comprises one or more magnets, a center portion of the first body is cylindrically bulged out to form the housing and an edge portion of the first body is flat, the edge portion being adapted to be coupled with the second body, said second body is flat with no openings and is configured to fix to a washing machine drum, and the hardness of said casing is less than 80 Shore A.

2. Dispenser for washing machines according to claim 1, wherein said structure is formed by a plurality of rods attached to one another.

3. Dispenser for washing machines according to claim 1, wherein said structure is of a plastic material.

4. Dispenser for washing machines according to claim 3, wherein said structure is of polyethylene, polypropylene or polyamide.

5. Dispenser for washing machines according to claim 1, wherein said casing is of elastomer.

6. Dispenser for washing machines according to claim 1, wherein said casing comprises at least one tab.

7. A kit of parts for washing machines comprising:

the dispenser for washing machines according to claim 1, the active substance, and the container for the active substance.

* * * * *